US011365892B2

(12) United States Patent
Nagai et al.

(10) Patent No.: US 11,365,892 B2
(45) Date of Patent: Jun. 21, 2022

(54) HEAT EXCHANGER AND INDOOR UNIT HAVING THE SAME

(71) Applicant: Samsung Electronics Co., Ltd., Suwon-si (KR)

(72) Inventors: Tadaharu Nagai, Yokohama (JP); Takeshi Takahara, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 97 days.

(21) Appl. No.: 16/629,227

(22) PCT Filed: Jul. 6, 2018

(86) PCT No.: PCT/KR2018/007727
§ 371 (c)(1),
(2) Date: Jan. 7, 2020

(87) PCT Pub. No.: WO2019/009681
PCT Pub. Date: Jan. 10, 2019

(65) Prior Publication Data

US 2020/0348031 A1 Nov. 5, 2020

(30) Foreign Application Priority Data

Jul. 7, 2017 (JP) ..... JP2017-133726
Jun. 15, 2018 (JP) ..... JP2018-114545

(51) Int. Cl.
*F24F 1/0063* (2019.01)
*F24F 1/0067* (2019.01)
(Continued)

(52) U.S. Cl.
CPC ..... *F24F 1/0063* (2019.02); *F24F 1/0007* (2013.01); *F24F 1/0067* (2019.02);
(Continued)

(58) Field of Classification Search
CPC ..... F24F 1/0063; F24F 1/0007; F24F 1/0053; F24F 1/0059; F24F 1/0047; F24F 1/0067;
(Continued)

(56) References Cited

U.S. PATENT DOCUMENTS 4,000,779 A 1/1977 Irwin
9,791,221 B1 * 10/2017 Litch ..... F25B 41/20
(Continued)

FOREIGN PATENT DOCUMENTS

EP 1659344 A1 5/2006
EP 2402669 A2 1/2012
(Continued)

OTHER PUBLICATIONS

ISA/KR, International Search Report and Written Opinion of the International Searching Authority, International Application No. PCT/KR2018/007727, dated Oct. 23, 2018, 13 pages.
(Continued)

*Primary Examiner* — Joseph F Trpisovsky

(57) ABSTRACT

Disclosed is a heat exchanger to reduce height and manufacturing cost. A heat exchanger includes a first heat exchanger provided in the form of a plate; and a second heat exchanger provided in the form of a plate and arranged to be inclined to the first heat exchanger, wherein a corner of at least one of an end of the first heat exchanger and an end of the second heat exchanger is positioned to face a plane of the other of the end of the first heat exchanger and the end of the second heat exchanger.

8 Claims, 9 Drawing Sheets

(51) Int. Cl.

| | |
|---|---|
| ***F24F 13/30*** | (2006.01) |
| ***F28F 9/00*** | (2006.01) |
| ***F24F 1/0007*** | (2019.01) |
| ***F28D 1/04*** | (2006.01) |
| *F28D 1/02* | (2006.01) |

(52) U.S. Cl.
CPC ..... *F24F 13/30* (2013.01); *F28D 1/0426* (2013.01); *F28F 9/005* (2013.01); *F28D 2001/0266* (2013.01)

(58) Field of Classification Search
CPC ..... F24F 13/30; F25D 17/067; F28F 2280/00; F28F 1/325; F28D 2001/0266; F28D 1/05391; F28D 1/05383; F28D 1/0426
See application file for complete search history.

(56) References Cited

U.S. PATENT DOCUMENTS

| | | | | |
|---|---|---|---|---|
| 2014/0224460 | A1* | 8/2014 | Means | F28D 1/05383 165/173 |
| 2015/0101362 | A1 | 4/2015 | Lee et al. | |
| 2015/0219348 | A1* | 8/2015 | Ikeda | F24F 1/0018 454/249 |
| 2016/0169586 | A1* | 6/2016 | Ito | F28D 1/05333 29/890.03 |
| 2017/0059188 | A1 | 3/2017 | Hancock | |
| 2017/0159967 | A1* | 6/2017 | Kawanori | F24F 13/222 |
| 2019/0257532 | A1* | 8/2019 | Sakabe | F24F 1/0063 |

FOREIGN PATENT DOCUMENTS

| | | | | |
|---|---|---|---|---|
| EP | 2722609 | A1 | 4/2014 | |
| EP | 3081867 | A1 | 10/2016 | |
| EP | 3081877 | A1 * | 10/2016 | F24F 13/22 |
| JP | H5-196249 | A | 8/1993 | |
| JP | 2015-183860 | A | 10/2015 | |
| JP | 2016-008730 | A | 1/2016 | |
| JP | 2016-223638 | A | 12/2016 | |
| WO | 2016042643 | A1 | 3/2016 | |
| WO | 2017/013775 | A1 | 1/2017 | |
| WO | 2017013775 | A1 | 1/2017 | |

OTHER PUBLICATIONS

Supplementary European Search Report dated Apr. 20, 2020 in connection with European Patent Application No. 18 82 7749, 11 pages.

Japan Patent Office, "Notice of Reason for Refusal" dated Apr. 26, 2022, in connection with Japanese Patent Application No. 2018-114545, 12 pages.

* cited by examiner

【FIG. 1】
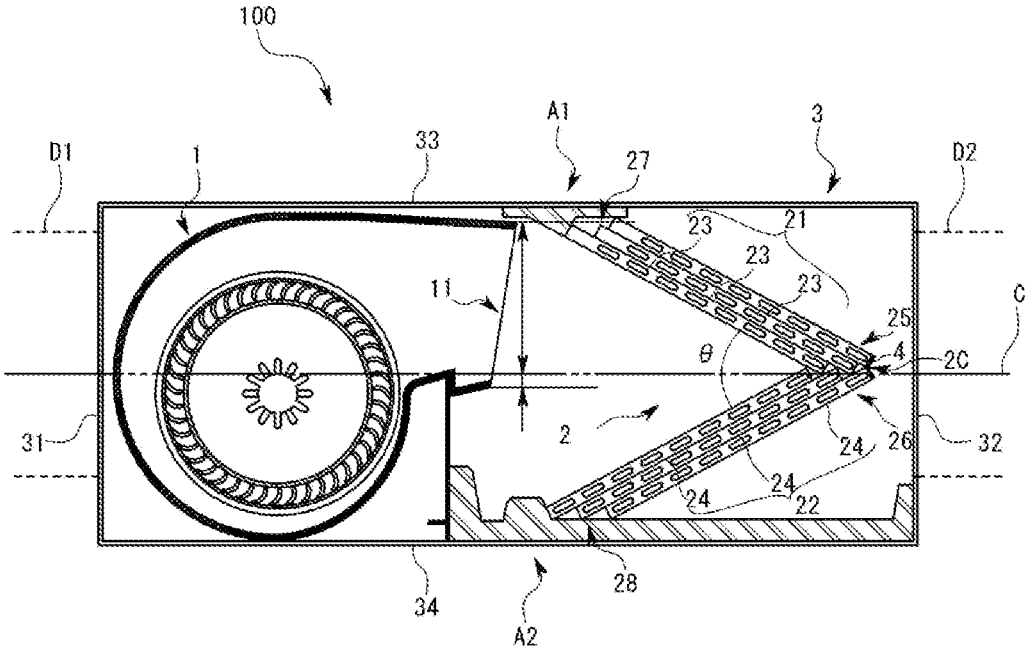

【FIG. 2】
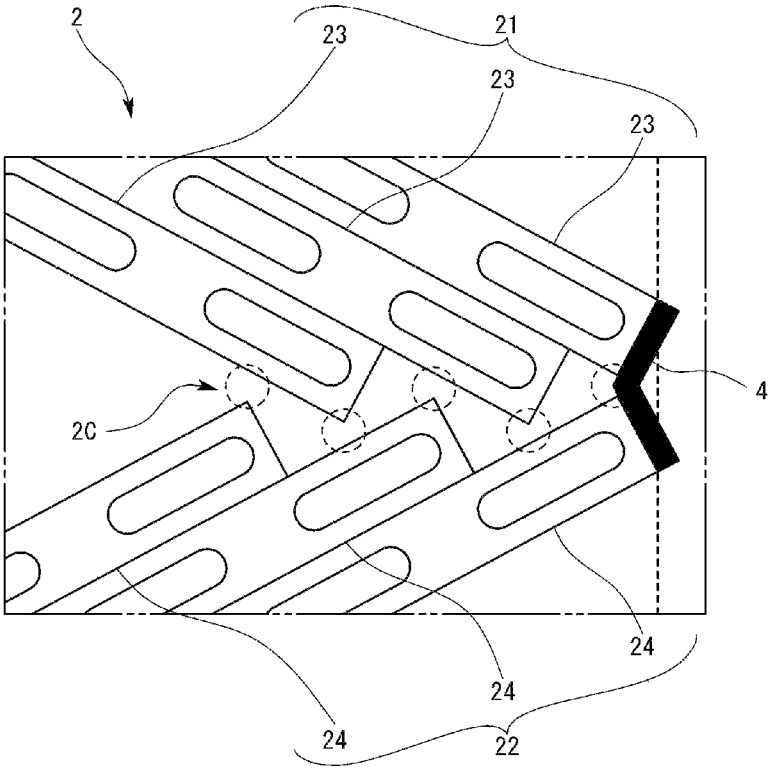

【FIG. 3】
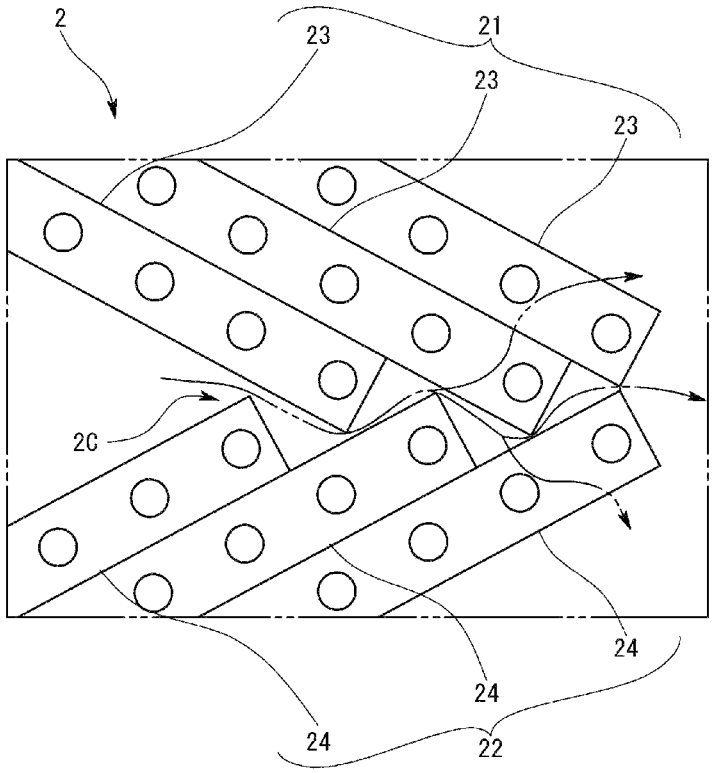

【FIG. 4】
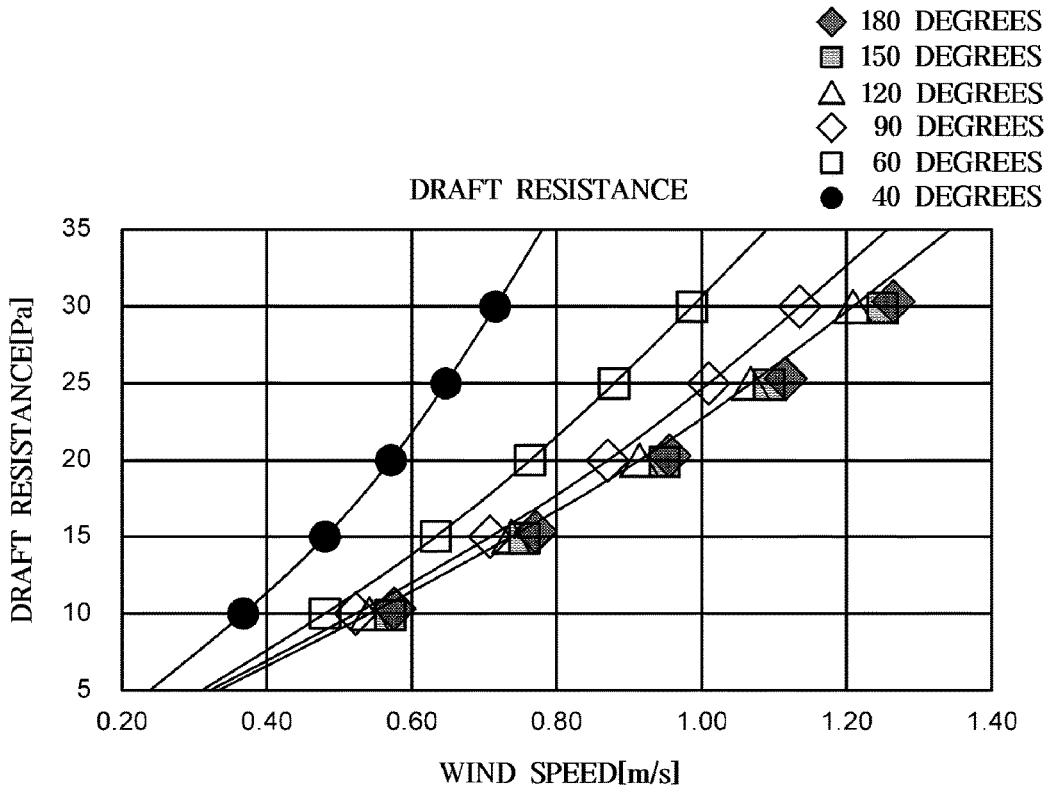

【FIG. 5】
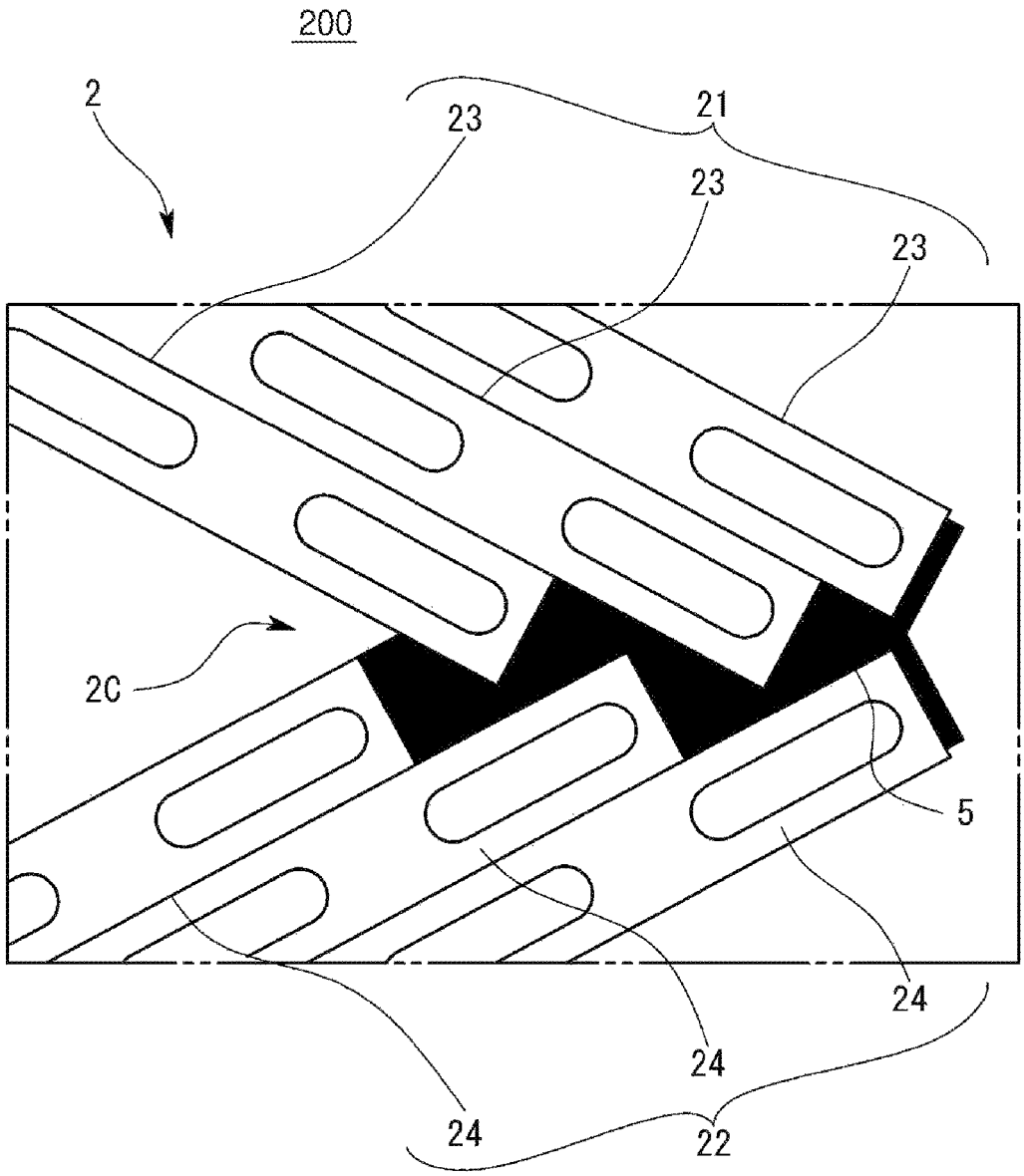

【FIG. 6】
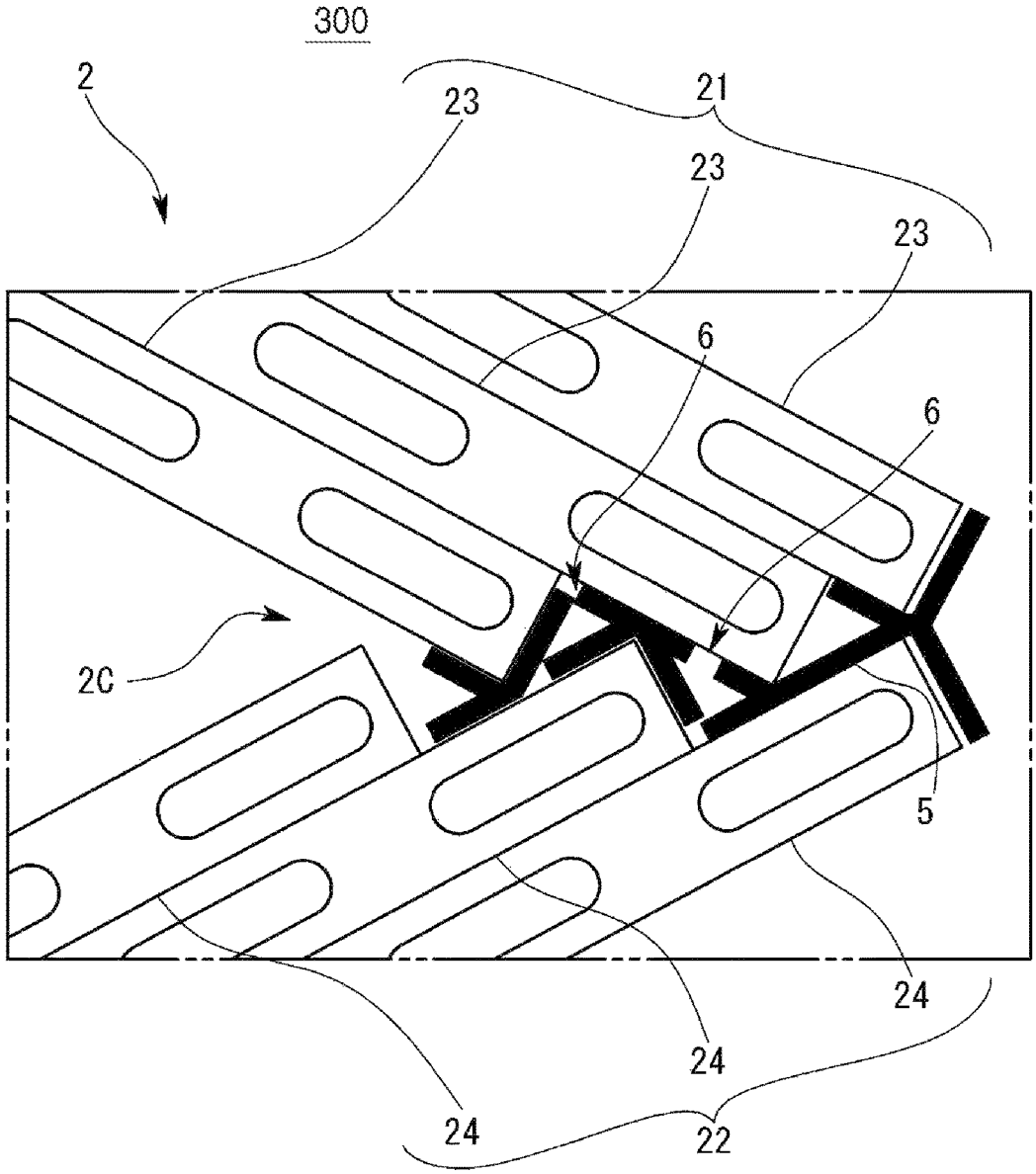

【FIG. 7】
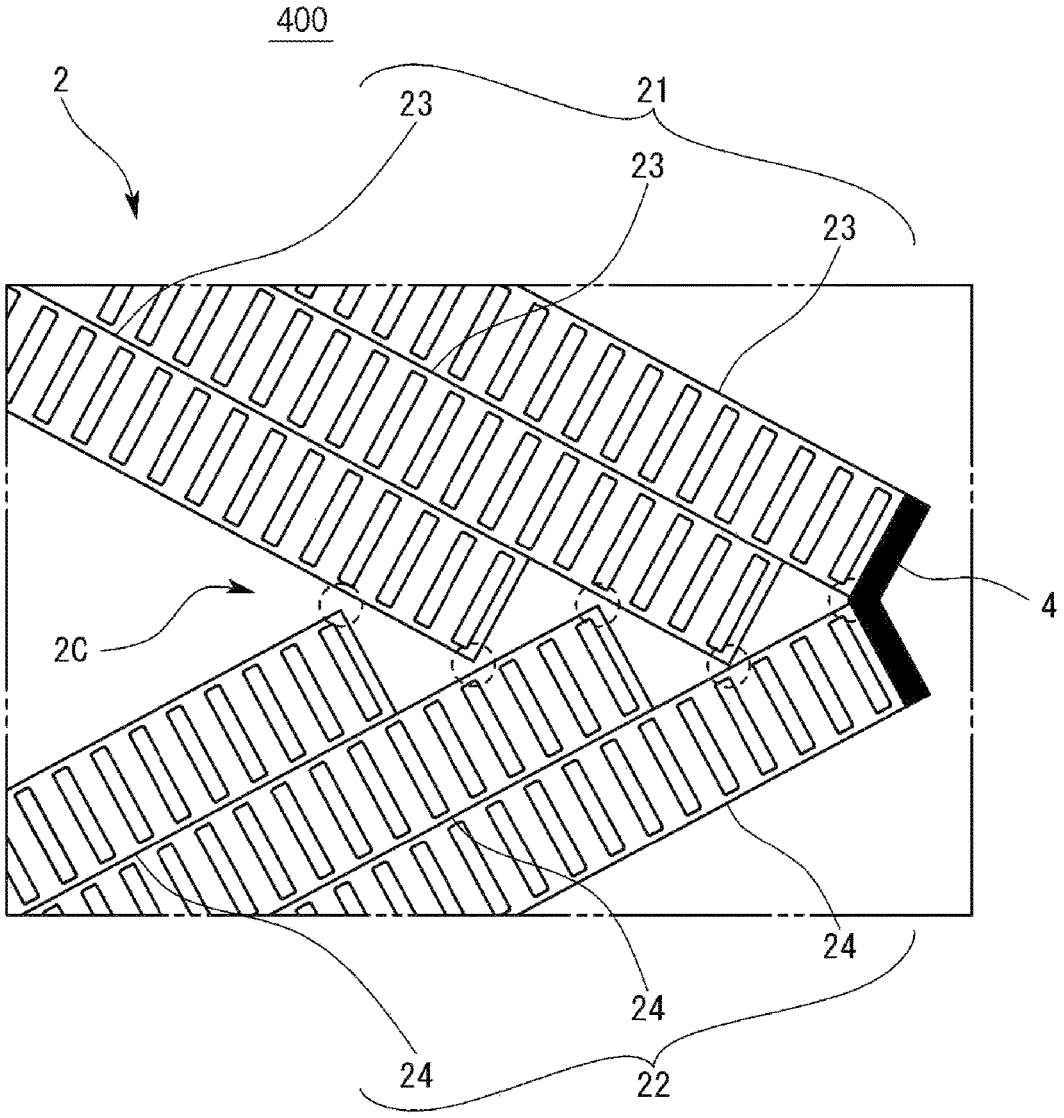

【FIG. 8】
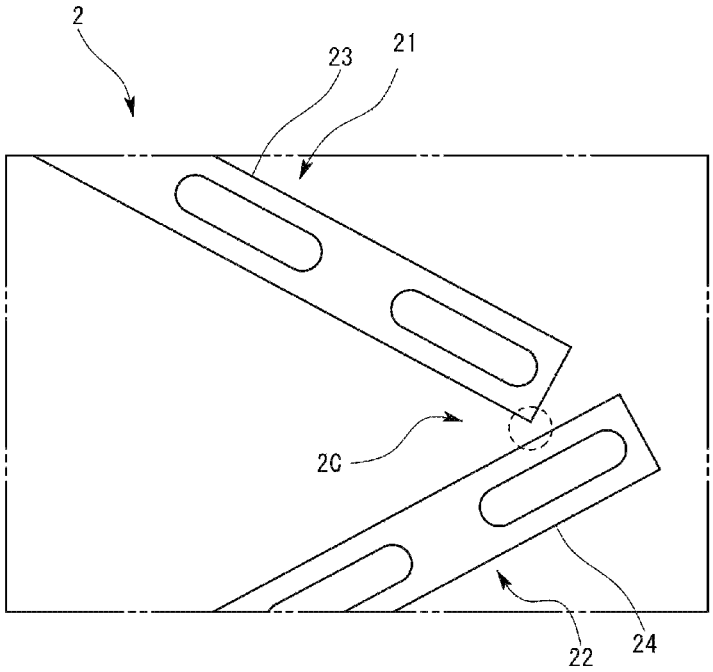

【FIG. 9】
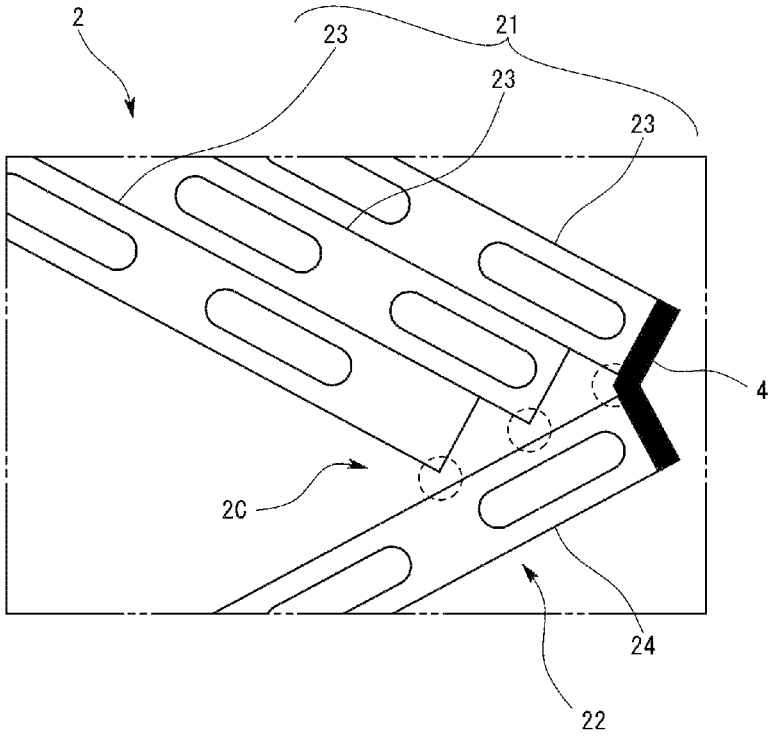

HEAT EXCHANGER AND INDOOR UNIT HAVING THE SAME

CROSS-REFERENCE TO RELATED APPLICATIONS

This application is a 371 National Stage of International Application No. PCT/KR2018/00772 filed Jul. 6, 2018, which claims priority to Japan Patent Application No. 2017-133726, filed Jul. 7, 2017, and Japan Patent Application No. 2018-114545, filed Jun. 15, 2018, the disclosures of which are herein incorporated by reference in their entirety.

BACKGROUND

Field

The disclosure relates to a heat exchanger used in an indoor unit of an air conditioner.

Description of Related Art

Built-in type air conditioners are commonly provided with an indoor unit installed on the space between the roof and the ceiling of a building and an outdoor unit connected to the indoor unit through refrigerant pipes or the like.

The indoor unit includes a fan blower and a heat exchanger through which air blown from the fan blower passes, and the air that has passed the heat exchanger flows to ducts coupled with various places in the building.

When the building has uniform height and the height of the indoor ceiling of the building is raised, the height of the space between the roof and the ceiling of the building is reduced. In other words, the space between the roof and the ceiling of the building has limited height depending on the height of the indoor ceiling of the building. Because of this, installation space is limited to the vertical height of the space between the roof and the ceiling of the building, so in order to install the indoor unit in the space between the roof and the ceiling of the building, the height of the indoor unit needs to be reduced.

Patent document 1 discloses that a heat exchanger is divided into first and second heat exchangers, which form 90 degrees and are connected to each other in the form of almost"<"('V' directed to a side) when viewed from a side. Such a structure may allow reduction in height of the indoor unit as compared with a structure in which the heat exchanger stands upright and has its face plane face a vent of the fan blower.

However, in the structure as disclosed in the patent document 1, height adjustment is difficult because it is impossible to make the angle between the first and second heat exchangers less than 90 degrees.

Moreover, as the first heat exchanger is arranged to contact the second heat exchanger, margins of dimensions of the respective members need to be strictly managed to avoid damage to the refrigerant pipes or the like due to interference occurring when the first and second heat exchangers are combined. This also causes a difficulty in reducing manufacturing costs from e.g., assembling.

PATENT DOCUMENT

Patent Document 1: JP Patent Publication No. 5995107

SUMMARY

The disclosure addresses the above problem and aims to provide a heat exchanger that has a smaller size than the conventional technology and may reduce manufacturing costs.

According to an embodiment of the disclosure, a heat exchanger includes a first heat exchanger provided in the form of a plate; and a second heat exchanger provided in the form of a plate and arranged to be inclined to the first heat exchanger, wherein a corner of at least one of an end of the first heat exchanger and an end of the second heat exchanger is positioned to face a plane of the other of the end of the first heat exchanger and the end of the second heat exchanger.

The at least one of the end of the first heat exchanger and the end of the second heat exchanger may be provided in a staircase shape.

The first heat exchanger may include a plurality of first heat exchange elements provided in the form of plates and layered not to overlay along a face plane direction, and a first staircase-shaped end formed by ends of the plurality of first heat exchange elements.

The second heat exchanger may include a plurality of second heat exchange elements provided in the form of plates and layered not to overlay along a face plane direction, and a second staircase-shaped end formed by ends of the plurality of second heat exchange elements.

A gap may be formed between corners and planes facing each other of the first and second staircase-shaped ends.

The first and second heat exchangers may form an angle equal to or greater than 20 degrees and equal to or less than 90 degrees.

The heat exchanger may further include a windshield plate for blocking the gap between the first and second heat exchangers.

The heat exchanger may further include at least one resin filling installed to fill the gap between the first and second heat exchangers.

The at least one resin filling may be provided in the plural, and the plurality of resin fillings may be separately arranged to form at least one flow path.

Each of the first and second heat exchangers may include fins and tubes.

Each of the first and second heat exchangers may include flat tubes and fins to form a plurality of refrigerant flow paths in parallel in the heat exchanger.

According to another embodiment of the disclosure, an indoor unit of an air conditioner includes a casing; an inlet duct connection hole and a vent duct connection hole formed at the casing; a fan blower for blowing air brought in through the inlet duct connection hole; and a heat exchanger for exchanging heat with the air blown by the fan blower, wherein the heat exchanger includes a first heat exchanger; a second heat exchanger arranged to be inclined to the first heat exchanger; and a coupling portion formed by an end of the first heat exchanger, an end of the second heat exchanger, and a gap between the end of the first heat exchanger and the end of the second heat exchanger.

The coupling portion may include at least one resin filling placed to fill the gap between the first and second heat exchangers.

the first and second heat exchangers may be connected by a tube in the coupling portion.

The indoor unit may further include a fixture installed in the casing to support an end of the first heat exchanger.

The fan blower may include an exhaust hole arranged to face the first heat exchanger.

The end of the first heat exchanger may include a plurality of first corners and the second heat exchanger may include a plurality of second corners, and the plurality of first corners and the plurality of second corners may be alternately positioned.

The plurality of first corners of the first heat exchanger may be positioned to face planes of the second heat exchanger.

The gap may be formed between the plurality of first corners of the first heat exchanger and planes of the second heat exchanger.

According to another embodiment of the disclosure, an indoor unit of an air conditioner includes a casing; an inlet duct connection hole and a vent duct connection hole formed at the casing; a fan blower for blowing air brought in through the inlet duct connection hole; and a heat exchanger for exchanging heat with the air blown by the fan blower, wherein the heat exchanger includes a first heat exchanger provided in the form of a plate; and a second heat exchanger provided in the form of a plate and arranged to be inclined to the first heat exchanger, wherein a corner of at least one of an end of the first heat exchanger and an end of the second heat exchanger is positioned to face a plane of the other of the end of the first heat exchanger and the end of the second heat exchanger.

According to the disclosure, a heat exchanger may be provided to reduce the height of an indoor unit and attain high efficiency.

Furthermore, as for a coupling portion of the heat exchanger, the gap formed between first and second heat exchangers may avoid interference between the first and second heat exchangers during the assembling, thereby reducing the manufacturing cost.

BRIEF DESCRIPTION OF THE DRAWINGS

FIG. 1 is a schematic diagram illustrating an indoor unit on the whole, according to a first embodiment of the disclosure;

FIG. 2 is a schematically enlarged view of surroundings of a coupling portion, according to the first embodiment of the disclosure;

FIG. 3 is a schematic diagram illustrating the flow of air in the surroundings of the coupling portion without a windshield plate, according to the first embodiment of the disclosure;

FIG. 4 is a graph representing differences in draft resistance depending on angles formed between first and second heat exchangers, according to the first embodiment of the disclosure;

FIG. 5 is a schematically enlarged view of surroundings of a coupling portion, according to a second embodiment of the disclosure;

FIG. 6 is a schematically enlarged view of surroundings of a coupling portion, according to a third embodiment of the disclosure;

FIG. 7 is a schematically enlarged view of surroundings of a coupling portion, according to a fourth embodiment of the disclosure;

FIG. 8 is a schematically enlarged view of surroundings of a coupling portion of a heat exchanger, according to another embodiments of the disclosure; and FIG. 9 is a schematically enlarged view of surroundings of a coupling portion of a heat exchanger, according to another embodiment of the disclosure.

DETAILED DESCRIPTION

An indoor unit 100 according to a first embodiment of the disclosure will now be described with reference to accompanying drawings.

The indoor unit 100 of the first embodiment is provided in a built-in type installed in space e.g., between the roof and the ceiling of a building. The indoor unit 100 and an outdoor unit installed outside the building and connected to the indoor unit 100 by a refrigerant pipe constitute an air conditioner. Air blown from the indoor unit 100 is guided to a vent duct D2 arranged inside the building and distributed by the vent duct D2 into each place in the building.

As shown in FIG. 1, the indoor unit 100 includes a fan blower 1, a heat exchanger 2 provided in the shape of almost "<" (the letter "V" directed to a side) to allow the air blown from the fan blower 1 to pass, casing 3 having a substantially rectangular form that receives the fan blower 1 and the heat exchanger 2 therein, and duct connection holes formed on the casing 3 and connected to the vent duct D2.

There are two duct connection holes formed on end planes of the casing 3 in the horizontal direction, one of the duct connection holes being an inlet duct connection hole 31 coupled to an inlet duct D1 through which air is sucked in from the indoor space, and the other of the duct connection holes being a vent duct connection hole 32 coupled to the vent duct D2 through which air blows into the indoor space. In other words, with respect to the casing 3, the air sequentially flows to the inlet duct D1, the fan blower 1, the heat exchanger 2, and the vent duct D2.

The fan blower 1 is, for example, a sirocco fan, which is a centrifugal fan blower 1, in which a tub-shaped fan body equipped with multiple wings is accommodated in a fan case. An exhaust hole 11 of the fan case is installed to face the concaved recess of the heat exchanger 2. Furthermore, based on a center plane C of the product, which is in the middle between a top plane 33 and a bottom plane 34 of the casing 3, the exhaust hole 11 is arranged to have an area located higher than the center plane C of the product to be larger than an area located lower than the center plane C of the product.

The heat exchanger 2 according to the first embodiment of the disclosure is provided in a fin-and-tube type consisting of fins and tubes in which a refrigerant flows, having a center that forms a certain angle.

Specifically, the heat exchanger 2 includes a first heat exchanger 21 and a second heat exchanger 22, each including three sheets of heat exchange element. The first and second heat exchangers 21 and 22 are connected by a tube at a coupling portion 2C forming the certain angle, and provided for the refrigerant to flow from one heat exchanger to the other heat exchanger.

As shown in FIGS. 1 and 2, the first heat exchanger 21 is formed with three panel-type first heat exchange elements 23 that are placed not to overlay each other along the face plane direction.

Both ends of the first heat exchanger 21 each have the shape of a staircase in which corners and planes are alternately formed. The plane mentioned herein is what forms a portion of the face plane of the heat exchange element. Specifically, for the first heat exchanger 21, a first staircase-shaped end 27 on the upper side has planes directed upward and another first staircase-shaped end 25 on the lower side has planes directed downward.

The first staircase-shaped end 27 on the upper side is supported by an upper fixture A1 installed on the inside top of the casing 3, and fixed to fill a gap between the casing 3 and the first heat exchanger 21.

Specifically, as for the first heat exchanger 21, a gap between the upper end of the innermost first heat exchange element 23 and the inside top of the casing 3 is blocked by the upper fixture A1. As the first staircase-shaped end 27 is formed on the upper side, ends of the second and third sheets of the first heat exchange elements 23 are placed lower than where the upper fixture A1 is installed.

Accordingly, due to the presence of the upper fixture A1, the air not subject to heat exchange is allowed to pass through the first heat exchange element 23 or a second heat exchange element 24. With the structure, the first heat exchanger 21 may be limited in height while increasing heat exchange efficiency.

As shown in FIGS. 1 and 2, the second heat exchanger 22 is formed with three panel-type second heat exchange elements 24 that are placed not to overlay each other along the face plane direction.

Similar to the first heat exchanger 21, ends of the second heat exchanger 21 have the shape of a staircase in which corners and planes are alternately formed. Specifically, for the second heat exchanger 22, a second staircase-shaped end 26 on the upper side has planes directed upward and another second staircase-shaped end 28 on the lower side has planes directed downward.

The second staircase-shaped end 28 on the lower side is supported by a fixture A2 installed on the inside bottom of the casing 3, and fixed to fill a gap between the casing 3 and the second heat exchanger 22.

Specifically, as for the second heat exchanger 22, a gap between the lower end of the innermost second heat exchange element 24 and the inside bottom of the casing 3 is blocked by the lower fixture A2. Due to the second staircase-shaped end 28 on the lower side, ends of the second and third sheets of the second heat exchange elements 24 are placed higher than where the lower fixture A21 is installed.

Accordingly, due to the presence of the lower fixture A2, the air not subject to heat exchange is allowed to pass the first heat exchange element 23 or the second heat exchange element 24. With the structure, the second heat exchanger 22 may be limited in height while increasing heat exchange efficiency.

The coupling portion 2C is formed by the first staircase-shaped end 25 on the lower side of the first heat exchanger 21 and the second staircase-shaped end 26 on the upper side of the second heat exchanger 22. When viewed from a side, the coupling portion 2C is formed for the first and second heat exchangers 21 and 22 to form a certain angle less than 90 degrees.

The certain angle is a sum of an angle of the face plane of the first heat exchanger 21 to the horizontal plane and an angle of the face plane of the second heat exchanger 22 to the horizontal plane, which is set to equal to or greater than 40 degrees and equal to or less than 90 degrees.

Relations between the certain angle formed by the first and second heat exchangers 21 and 22 and draft resistance are represented in a graph of FIG. 3. It may be seen from the graph that with the certain angle set to equal to or greater than 40 degrees and equal to or less than 90 degrees, the folded heat exchangers may reduce its height and have suitable draft resistance for operation of the indoor unit 100.

Furthermore, as shown in FIG. 1, in the first embodiment of the disclosure, the first and second heat exchangers 21 and 22 are arranged so that the angle of the face plane of the first heat exchanger 21 to the horizontal plane is greater than the angle of the face plane of the second heat exchanger 22 to the horizontal plane.

The inside face plane of the first heat exchanger 21 is positioned to face the exhaust hole 11 to substantially cover the exhaust hole 11 when the inside face plane of the first heat exchanger 21 is projected onto the fan blower 1.

Furthermore, in the first embodiment of the disclosure, the first and second heat exchangers 21 and 22 are arranged to be inclined to the horizontal plane to prevent overlaying of tubes when horizontally viewed from the exhaust hole 11 of the fan blower 1.

Furthermore, as shown in FIG. 2, in the coupling portion 2C, there are gaps formed between all the planes and corners. In other words, the first and second heat exchangers 21 and 22 are arranged not to contact each other in the coupling portion 2C. As the gaps (shown in dotted circles of FIG. 2) are set to be greater than a maximum of dimension margins or assembly errors of the first and second heat exchangers 23 and 24, the staircase-shaped end 25 of the first heat exchanger 21 does not interfere with the staircase-shaped end 26 of the second heat exchanger 22 during the assembling.

Although the gaps are formed between all the corners and planes in the first embodiment of the disclosure, it is possible to form the gap between at least one corner and plane to achieve easiness of assembling.

In the coupling portion 2C, a V-shaped windshield plate 4 may be installed on the end planes of the first and second heat exchange elements 23 and 24, each located on the outermost sides with respect to the fan blower 1, to block the gap between the first and second heat exchange elements 23 and 24.

Without installation of the windshield plate 4 as shown in FIG. 3, the flow of air converges on the gap of the coupling portion 2C, so the air may happen to pass only a row of heat exchange element.

As shown in FIG. 2, when the windshield plate 4 is installed, it may make the overall draft resistance uniform, facilitating passing of the air through the whole of the first and second heat exchangers 21 and 22.

Furthermore, as the first and second staircase-shaped ends 25 and 27 are fixed by the windshield plate 4, good visibility may be achieved when assembling is performed to have gaps formed between the ends in the coupling portion 2C. This may facilitate assembling of the heat exchangers without interference, thereby improving the assembling performance.

Furthermore, as the windshield plate 2C is installed at the end of the downstream in the heat exchanger 2, even when, for example, condensation occurs in the first heat exchanger 21 and the water drops fall down e.g., the fins, onto the first staircase-shaped end 25 in the lower side or into the coupling portion 2C, the water drops are prevented from being scattered by the air from the fan blower 1 to the outside.

Moreover, the heat exchange elements are arranged so that in the coupling portion 2C, the nearest portion of the first heat exchanger 21 to the vent duct connection hole 32 and the nearest portion of the second heat exchanger 21 to the vent duct connection hole 32 are arranged in line with respect to the vertical direction. In other words, when a vertical line is drawn from each point of the first heat exchanger 21, the vertical line intersects with the second heat exchanger 2. Accordingly, the condensation water generated from the first heat exchanger 21 falls to the second heat exchanger 22, runs down the second heat exchanger 22 and is discharged through a drain not shown.

According to the indoor unit 100 of the embodiment of the disclosure as described above, the plurality of plate-shaped heat exchange elements are provided not to overlay each other along a direction of the face plane, and the coupling portion 2C is formed to have a certain angle formed by a combination of staircase-shaped ends corresponding to each other, thereby restricting the height of the heat exchanger 2 in the vertical direction.

Furthermore, as the gaps are formed between corners and planes of the staircase-shaped ends in the coupling portion 2C, the first and second heat exchangers 21 and 22 may be prevented from interfering with each other and causing damage to the fins or tubes while being assembled, without need to strictly manage dimension margins or assembly precision of the first and second heat exchangers 21 and 22. Accordingly, even when the heat exchanger 2 is formed as if it were bent into the shape of "<", a rise in manufacturing cost may be avoided.

According to the indoor unit 100 of the embodiment of the disclosure as described above, it is possible to realize an air conditioner to fit in as small space between the roof and the ceiling as possible with the high ceiling of the building and thus with bigger living space, having a low price and equal cooling efficiency to the ordinary air conditioner.

An indoor unit 200 according to a second embodiment of the disclosure will now be described with reference to FIG. 5.

The indoor unit 200 has the same coupling portion 2C as in the indoor unit 100 of the first embodiment of the disclosure. The coupling portion 2C of the indoor unit 200 of the second embodiment of the disclosure further includes a resin filling 5 provided to fill space between the first and second heat exchangers 21 and 22.

When viewed from a side, the resin filling 5 is provided as a cylindrical member in the shape of uniform sections having almost the same sections as the sections of space formed between the first staircase-shaped end 25 of the first heat exchanger 21 and the second staircase-shaped end 26 of the second heat exchanger 22.

For example, after the first and second heat exchangers 21 and 22 are installed in the casing 3, the resin filling 5 is inserted to the coupling portion 2C from a side. Alternatively, after the second heat exchanger 22 is installed in the casing 3, the resin filling 5 is installed on the staircase-shaped end 26 of the second heat exchanger 22, and then the first heat exchanger 21 may be installed by fitting the staircase-shaped end 25 to the resin filling 5.

According to the indoor unit 200 of the second embodiment of the disclosure as described above, by blocking all the gap in the coupling portion 2C to prevent air exhausted from the fan blower 1 from passing through the gap, the air may be allowed to pass only the first and second heat exchangers 21 and 22. This may further increase heat exchange efficiency of the heat exchanger 2.

Furthermore, the resin filling 5 provided in the coupling portion 2C may prevent the first and second heat exchangers 21 and 22 from interfering with each other, making the assembling easy and thus reducing the manufacturing cost.

Moreover, it is possible to secure a flow path for the condensation water to flow from the first heat exchanger 21 to the second heat exchanger 22 by making the resin filling 5 as a continual foam. In other words, the resin filling 5 may be formed of a fine porous material instead of a completely solid core material.

An indoor unit 300 according to a third embodiment of the disclosure will now be described with reference to FIG. 6.

The indoor unit 300 has the same coupling portion 2C as in the indoor unit 100 of the first embodiment of the disclosure. Unlike in the second embodiment of the disclosure, the indoor unit 300 of the third embodiment of the disclosure does not block all the gap of the coupling portion 2C with the resin filling 5.

In the coupling portion 2C of the indoor unit 300 of the third embodiment of the disclosure, the resin filling 5 is attached between the corner and the plane, and at least one flow path 6 is formed by the gap that runs from the staircase-shaped end 25 of the first heat exchanger 21 to the staircase-shaped end 26 of the second heat exchanger 22. In other words, by dividing the resin filling 5 into multiple pieces, at least one flow path 6 is formed.

According to the indoor unit 300 of the third embodiment of the disclosure as described above, the air exhausted from the fan blower 1 hardly passes the coupling portion 2C, and the condensation water generated from the first heat exchanger 21 reaches the second heat exchanger 22 through the flow path 6, runs down the second heat exchanger 22, and is discharged through a drain.

An indoor unit 400 according to fourth embodiment of the disclosure will now be described with reference to FIG. 7.

In the indoor unit 400 of the fourth embodiment of the disclosure, the heat exchanger 2 is not implemented in the fin-and-tube type but in the micro channel type. Specifically, the plate shaped first and second heat exchange elements 23 and 24 are each provided to have multiple micro channels and flat tubes extending in the vertical depth direction layered along the face plane direction so that corrugated fins are inserted between the flat tubes.

According to the indoor unit 400 of the fourth embodiment of the disclosure, it is possible to further increase heat exchange efficiency for air and reduce the height of the indoor unit 400 itself.

Other modified embodiments will now be described.

As shown in FIG. 8, the first and second heat exchangers 21 and 22 are each composed of one sheet of heat exchange element 23 or 24, and only the corner of the first heat exchanger 21 is positioned to form a gap with the plane of the second heat exchanger 22.

Alternatively, only the corner of the second heat exchanger 22 may be positioned to form a gap with the plane of the first heat exchanger 21.

That is, according to the disclosure, the heat exchanger 2 may be arranged so that the corner of at least one of the heat exchangers 21 and 22 forms a gap with the plane of the other heat exchanger.

As shown in FIG. 9, the first heat exchanger 21 may be provided with a plurality of first heat exchange elements 23 layered not to overlay in the face plane direction while the second heat exchanger 22 may be provided with one sheet of second heat exchange element 24.

With the structure, as shown in FIG. 9, all the corners of the first heat exchange elements 23 may be positioned to face the plane of the second heat exchanger 22 with gaps, or alternatively, the corner of only at least one first heat exchange element 23 is positioned to face the plane of the second heat exchanger 22 with a gap.

Even the heat exchanger 2 as shown in FIGS. 8 and 9 may have the same effect as in the heat exchanger applied to the indoor units 100 to 400 of the first to fourth embodiments of the disclosure.

In the coupling portion 2C, the gap formed between the first and second heat exchangers 21 and 22 may be provided between not all the corners and planes of the first and second heat exchangers 21 and 22 but at least one corner and plane.

The first and second heat exchangers 21 and 22 each need to include a plurality of heat exchange elements, which is not limited to three rows of the heat exchange elements. Furthermore, a sum of the angle of the first heat exchanger 21 to the horizontal plane and the angle of the second heat exchanger 22 to the horizontal plane may be in a range from 20 degrees to 90 degrees.

The heat exchanger according to the disclosure may also be employed in other applications apart from the built-in type indoor unit, and may be applied not only to a structure in which the first and second heat exchangers are vertically arranged but also to a structure in which they are arranged in the left-right direction (horizontal direction). In addition, not only to the indoor unit, the heat exchanger according to the disclosure is also applied to the outdoor unit.

It is possible to combine or modify various embodiments of the disclosure as long as the combination or modification does not deviate from the purpose of the disclosure.

Several embodiments have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

The invention claimed is:

1. An air conditioner comprising:

a casing;

an upper fixture installed on an upper portion of an inner side of the casing;

a lower fixture installed on a lower portion of the inner side of the casing;

an inlet duct connection hole and a vent duct connection hole formed at the casing;

a fan blower configured to blow air brought in through the inlet duct connection hole; and a heat exchanger configured to exchange heat with the air blown by the fan blower, wherein the heat exchanger comprises:

a first heat exchanger provided in a form of a plate and including a plurality of first heat exchange elements, a first end and a second end of the first heat exchanger each having a shape of a staircase in which corners and planes are alternately formed; and a second heat exchanger provided in a form of a plate and arranged to be inclined to the first heat exchanger, the second heat exchanger including a plurality of second heat exchange elements, a first end and a second end of the second heat exchanger each having a shape of a staircase in which corners and planes are alternately formed, wherein a corner of the first end of the first heat exchanger is positioned to face a plane between the first end and the second end of the second heat exchanger, wherein the second end of the first heat exchanger is supported by the upper fixture, and wherein the second end of the second heat exchanger is supported by the lower fixture.

2. The air conditioner of claim 1, wherein a gap is formed between the first end of the first heat exchanger and the first end of the second heat exchanger.

3. The air conditioner of claim 1, wherein the first and second heat exchangers form an angle equal to or greater than 20 degrees and equal to or less than 90 degrees.

4. The air conditioner of claim 2, further comprising:

a windshield plate for blocking the gap between the first and second heat exchangers.

5. The air conditioner of claim 2, further comprising:

at least one resin filling installed to fill the gap between the first and second heat exchangers.

6. The air conditioner of claim 5, wherein the at least one resin filling is provided in the plural, and the plurality of resin fillings are separately arranged to form at least one flow path.

7. The air conditioner of claim 1, wherein each of the first and second heat exchangers comprises fins and tubes.

8. The air conditioner of claim 1, wherein each of the first and second heat exchangers comprises flat tubes and fins to form a plurality of refrigerant flow paths in parallel in the heat exchanger.

* * * * *